US011251555B2

(12) United States Patent
Lin et al.

(10) Patent No.: US 11,251,555 B2
(45) Date of Patent: Feb. 15, 2022

(54) FLOATING CONNECTOR FOR FLOATING CONNECTION

(71) Applicant: P-TWO INDUSTRIES INC., Taoyuan (TW)

(72) Inventors: Hsien-Chang Lin, Taoyuan (TW); Chun-Wei Chang, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/924,275

(22) Filed: Jul. 9, 2020

(65) Prior Publication Data

US 2021/0265757 A1 Aug. 26, 2021

(30) Foreign Application Priority Data

Feb. 24, 2020 (TW) ..... 109106125

(51) Int. Cl.

| | |
|---|---|
| ***H01R 12/91*** | (2011.01) |
| ***H01R 24/52*** | (2011.01) |
| ***H01R 12/71*** | (2011.01) |
| ***H01R 13/631*** | (2006.01) |

(52) U.S. Cl.

CPC ..... *H01R 12/91* (2013.01); *H01R 12/714* (2013.01); *H01R 13/6315* (2013.01); *H01R 24/52* (2013.01)

(58) Field of Classification Search

CPC .. H01R 12/91; H01R 12/714; H01R 13/6315; H01R 13/506; H01R 13/508; H01R 24/52

USPC ..... 439/818, 247, 846, 65

See application file for complete search history.

(56) References Cited

U.S. PATENT DOCUMENTS

| | | | | |
|---|---|---|---|---|
| 6,830,469 | B1 * | 12/2004 | Doyle | H01R 13/6273 439/247 |
| 6,971,901 | B2 * | 12/2005 | Chiu | H01R 12/79 439/329 |
| 7,559,772 | B2 * | 7/2009 | Tsai | H01R 12/592 439/495 |
| 7,601,017 | B2 * | 10/2009 | Wang | H01R 12/79 439/260 |
| 7,712,215 | B2 * | 5/2010 | Wang | H01R 12/79 29/876 |
| 9,660,370 | B2 * | 5/2017 | Ashibu | H01R 12/79 |
| 2008/0296133 | A1 * | 12/2008 | Ura | H01R 13/6315 200/1 A |
| 2012/0135621 | A1 * | 5/2012 | Hayauchi | H01R 12/91 439/247 |

(Continued)

*Primary Examiner* — Marcus E Harcum

(57) ABSTRACT

A floating connector includes a shell, a plurality of electrodes, two buckle members and a floating member. The shell has an accommodating space and a plurality of openings. The electrodes are disposed in the accommodating space and penetrate the openings to protrude from the openings. The buckle members are respectively disposed on two sides of the accommodating space. Each of the buckle members includes a fixed part, a contacting part, and an elastic part. The floating member includes a body, a plurality of electrode notches, and a bump. The electrode notches are formed on one side of the body that near the electrodes for receiving the electrodes protruding from the openings. The bump is disposed on the body and correspondingly to the notch, and the width of the bump is not greater than that of the notch, so that the bump is restricted in the notches by the guiding structure.

8 Claims, 12 Drawing Sheets

(56) References Cited

U.S. PATENT DOCUMENTS

| | | | | |
|---|---|---|---|---|
| 2016/0093980 | A1* | 3/2016 | Beischer | H01R 13/639<br>439/345 |
| 2016/0118735 | A1* | 4/2016 | Hoyack | H01R 12/91<br>439/247 |
| 2017/0141496 | A1* | 5/2017 | Kiryu | H01R 12/72 |
| 2017/0214161 | A1* | 7/2017 | Yamada | H01R 13/055 |
| 2020/0127410 | A1* | 4/2020 | Shioda | H01R 13/11 |

* cited by examiner

FLOATING CONNECTOR FOR FLOATING CONNECTION

CROSS REFERENCE TO RELATED APPLICATIONS

The present application claims the benefit of Taiwanese Patent Application No. 109106125 filed on Feb. 24, 2020, the contents of which are incorporated herein by reference in their entirety.

FIELD OF TECHNOLOGY

The invention relates to a connector, especially relates to a floating connector for floating connection.

BACKGROUND

Traditionally, a connector electrically connects a male terminal and a female socket.

In the process of connection, it is inevitable to be encountered with problems of how to align and connect, how to increase the assembling speed, how to decrease the damage rate of assembly, and how easy it is to be disconnected after connected, etc.

Accordingly, the invention provides a floating connector to solve the drawbacks of prior arts.

SUMMARY

According to a first aspect of this invention, a floating connector is provided. The floating connector comprises a shell, a plurality of electrodes, buckle members, and a floating member to achieve floating assembling.

According to a second aspect of this invention, the above floating connector further comprises buckle members and a floating member to achieve connecting and disconnecting.

According to a third aspect of this invention, in the above floating connector, the shell has an alignment block, and the floating member has an alignment notch. Accordingly, the alignment block is inserted into the alignment notch to achieve aligning the electrodes to the electrode notches and buckling the alignment block in the alignment notch.

According to a fourth aspect of this invention, in the above floating connector, the alignment notch has a guiding incline to restrict the alignment block to the alignment notch.

According to a fifth aspect of this invention, in the above floating connector, a guiding structure is inserted into the alignment notch to block a notch on the guiding structure by the bump of the alignment notch.

According to a sixth aspect of this invention, in the floating connector, the elastic part is deformed by an external force to release the bump from the notch. Accordingly, the buckle member is then disconnected from the floating member.

According to a seventh aspect of this invention, in the floating connector, the bump comprises a guiding incline to buckle the bump to the notch by contacting a contacting part with a guiding structure through the guiding incline to deform the elastic part and buckle the bump to the notch.

According to an eighth aspect of this invention, in the floating connector, the guiding structure comprises a pick exposed outside the shell. The restricted state of the bump by the notch may be changed by the deformation of the elastic part resulted from the pick.

According to a ninth aspect of this invention, in the floating connector, the guiding structure comprises a fillet (or called as an arc) to buckle the bump to the notch successfully.

Accordingly, this invention provides a floating connector comprising a shell, a plurality of electrodes, two buckle members, and a floating member. The shell has an accommodating space and a plurality of openings. The electrodes are disposed in the accommodating space and penetrate the openings to protrude from the openings. The buckle members are respectively disposed on two sides of the accommodating space, wherein each of the buckle members comprises a fixed part, a contacting part, and an elastic part. Each of the fixed parts is disposed in the accommodating space. Each of the contacting parts comprises a notch and a guiding structure. Each of the elastic parts connects the fixed part and the contacting part and is disposed near the outer surface of the shell. The floating member combines the electrodes and the buckle members, wherein the floating member comprises a body, a plurality of electrode notches, and a bump. The electrode notches are formed on one side of the body that near the electrodes for receiving the electrodes protruding from the openings. The bump is disposed on the body and correspondingly to the notch, and the width of the bump is not greater than the width of the notch so that the bump is restricted in the notches by the guiding structure.

In comparison to prior arts, this invention provides two buckle members and a floating member, so that an assembler can electrically connect an electrode to another electrode provided in an electrode notch within an allowable range. In an embodiment, the buckle members may be firmly locked to the floating member. In another embodiment, the buckle members may be not only locked to the floating member but also unlocked and separated from the floating member for connection of multiple times.

DETAILED DESCRIPTION

In order to fully demonstrate the aspects, features, and effects of this invention, the following specific examples and the drawings are used to make a detailed description of this invention.

In this invention, "a/an" or "one" is used to describe the units, elements and components described herein, which is only for convenience of explanation and providing a general meaning to the scope of this invention. Therefore, unless clearly stated otherwise, such description should be understood to include one, at least one, and the singular also includes the plural.

In this invention, the terms "comprise," "include," "have," "contain" or any other similar are intended to cover non-exclusive inclusions. For example, a component, structure, product, or device comprising multiple elements is not limited to the elements listed here but may comprise those not explicitly listed but generally inherent thereto. Besides, unless clearly stated to the contrary otherwise, the term "or" refers to an inclusive "or" rather than an exclusive "or".

Figure 1:
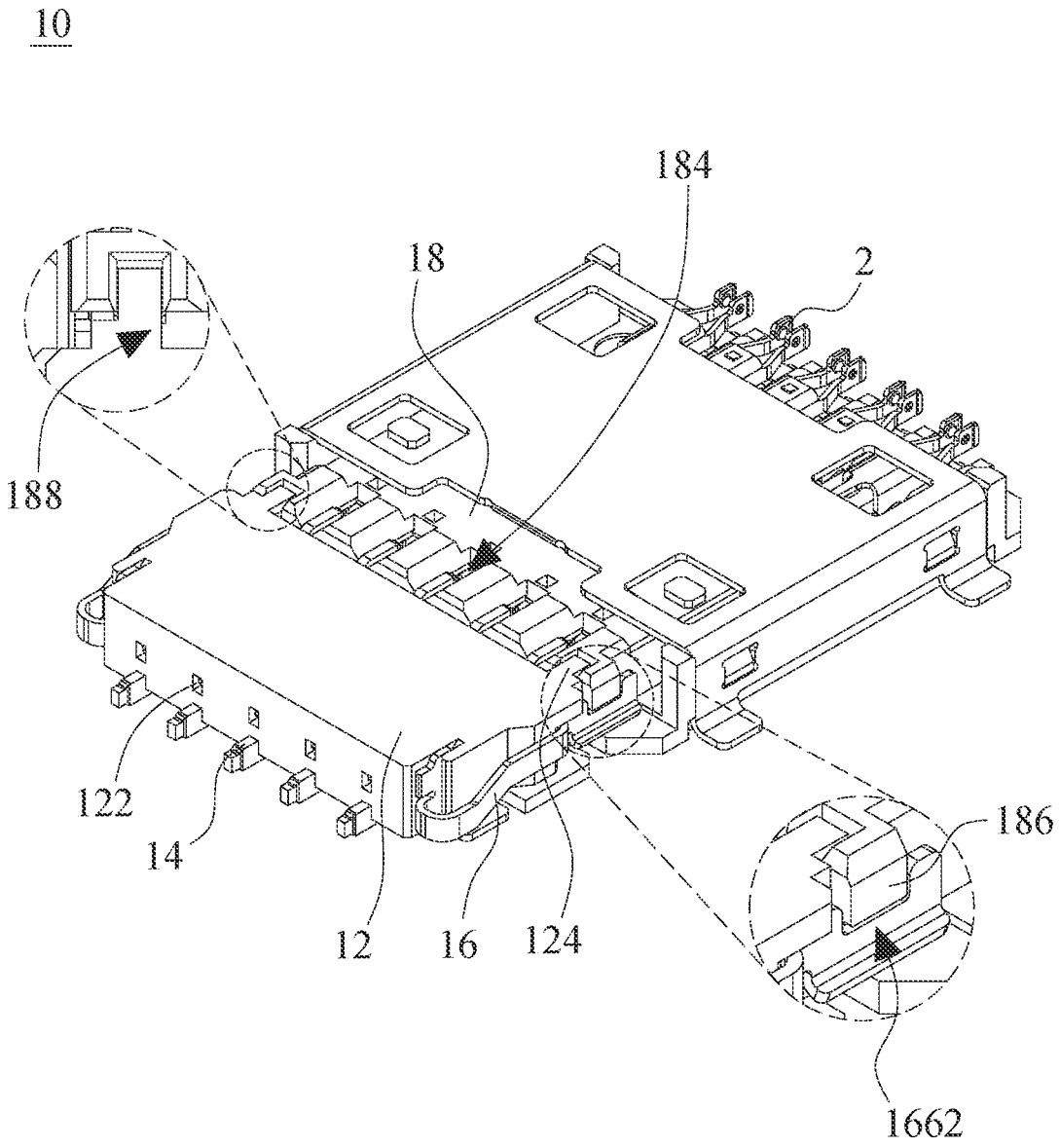
FIG. 1 is a schematic perspective diagram of a floating connector according to an embodiment of the invention.

FIG. 1 is a schematic perspective diagram of a floating connector according to an embodiment of the invention. In FIG. 1, a floating connector 10 may be connected to an external terminal 2. The external terminal 2 may be provided by another connector or a printed circuit board, etc.

The floating connector 10 comprises a shell 12, a plurality of electrodes 14, two buckle members 16, and a floating member 18.

Figure 2:
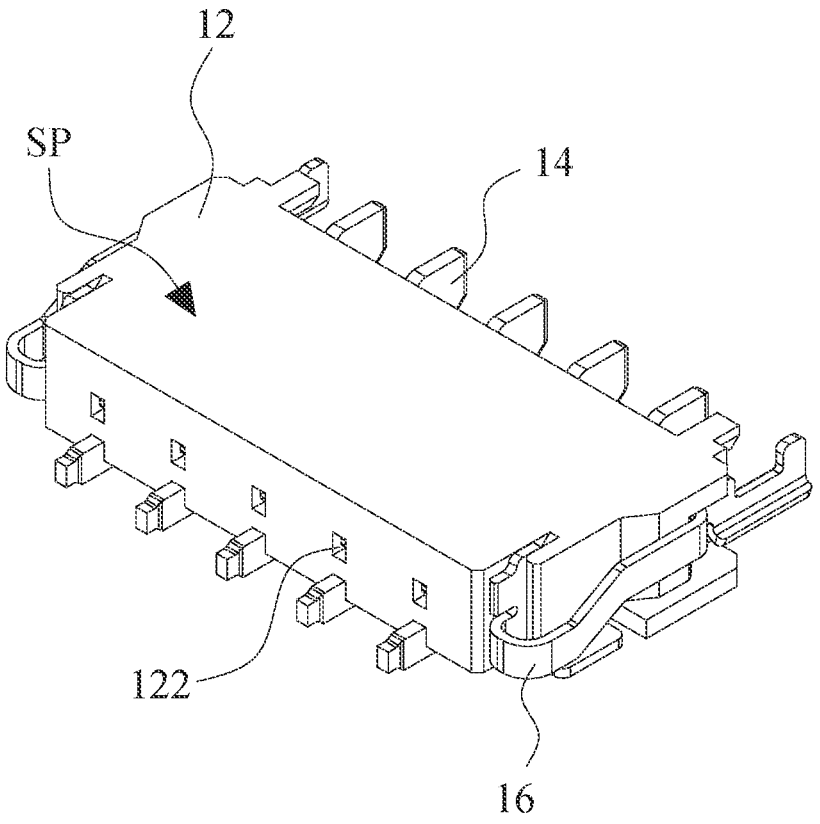
FIG. 2 is a schematic perspective diagram of the shell, the electrodes and the buckle members in FIG. 1.

FIG. 2 is a schematic perspective diagram of the shell, the electrodes and the buckle members in FIG. 1. The shell 12, the electrodes 14 and the buckle members 16 may be referred to in FIG. 2.

Figure 3:
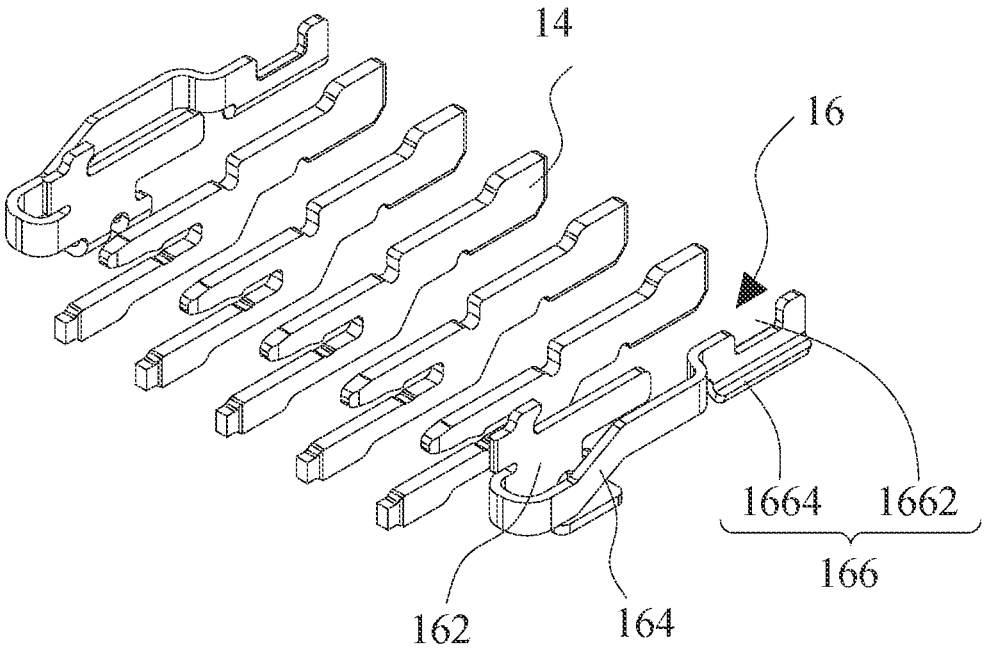
FIG. 3 is a structural schematic diagram of the electrodes and the buckle members in FIG. 1.

FIG. 3 is a structural schematic diagram of the electrodes and the buckle members in FIG. 1. Referring together with FIG. 3, the shell 12 has an accommodating space SP and a plurality of openings 122. Herein, the number of the openings 122 is mainly arranged for needs of the electrodes 14 and the buckle members 16. In this embodiment, for exemplary illustration, the number of the electrodes 14 is 5 and the number of the buckle members is 2. The above numbers may be unlimited in other embodiments.

In FIG. 1, the electrodes 14 are disposed in the accommodating space SP. The electrodes 14 penetrate the openings 122 to protrude from the openings 122 for welding or contacting with another electrode to receive or transmit electricity or digital signals.

Figure 4:
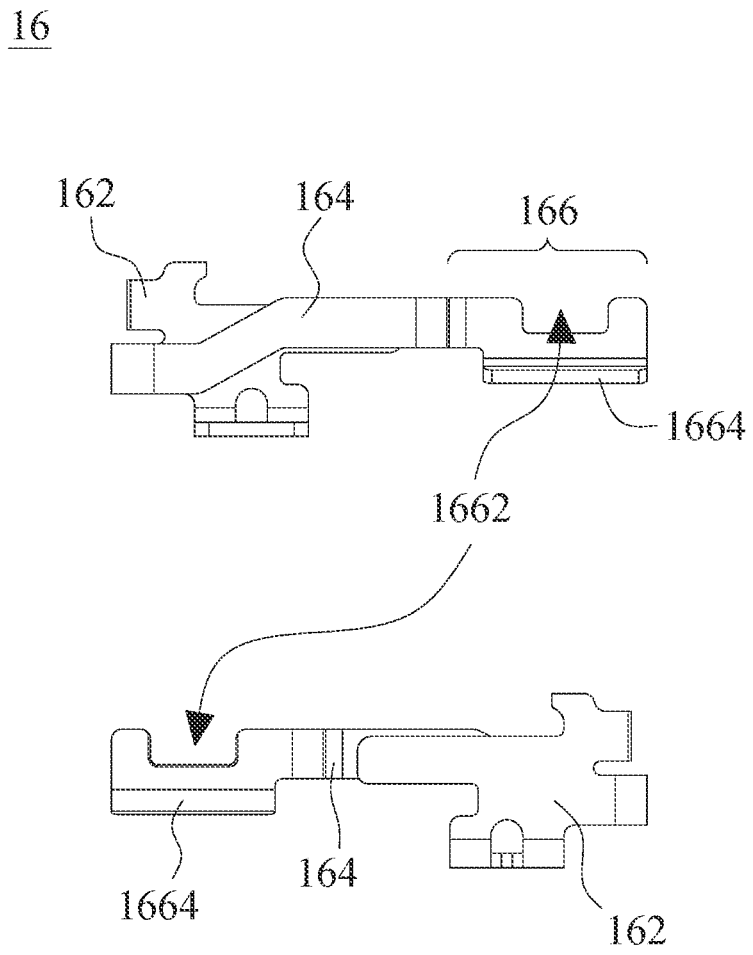
FIG. 4 is a side view diagram of the buckle members in FIG. 1.

FIG. 4 is a side view diagram of the buckle members in FIG. 1. In FIG. 4, the upper is a side view from one side of the buckle members, and the lower is a side view from the side opposite to the one side of the buckle members. The two buckle members 16 are respectively disposed on two sides of the accommodating space SP, wherein each of the buckle members 16 comprises a fixed part 162, a contacting part 166, and an elastic part 164.

In another embodiment, the fixed part 162 is disposed in the accommodating space SP and welded onto a printed circuit board.

The elastic part 164 connects the fixed part 162 and the contacting part 166. In this embodiment, the elastic part 164 is the part exposing on the shell 12 as well as is disposed near the outer surface of the shell 12. The elastic part 164 protrudes from the fixed part 162 and is bent at an angle (such as U-shaped) to connect an end of the elastic part 164 to the fixed part 162, so that the elastic part 164 is elastic when subjected to an external force.

The contacting part 166 further extends from the elastic part 164, that is, the contacting part 166 is disposed at the front end of the buckle members 16. The contacting part 166 further comprises a notch 1662 and a guiding structure 1664.

Figure 5:
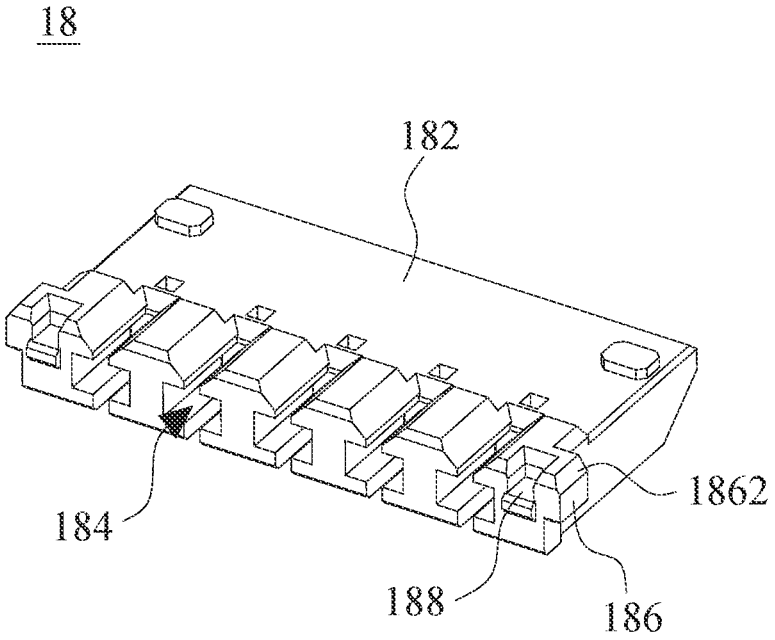
FIG. 5 is a structural schematic diagram of the floating member in FIG. 1.

FIG. 5 is a structural schematic diagram of the floating member in FIG. 1. In FIG. 5, the floating member 18 combines the electrodes 14 and the buckle members 16. The floating member 18 may be disposed on another connector such as a female-socket connector. The floating member 18 comprises a body 182, a plurality of electrode notches 184, and a bump 186. The number of the electrode notches 184 is arranged correspondingly to the number of the electrodes 14. The electrode notches 184 are formed on one side of the body 182 that near the electrodes 14. In this embodiment, the bumps 186 are disposed on two sides of the body 182 corresponding to the notches 1662. Moreover, the widths of the bumps 186 are not greater than the widths of the notches 1662, so that the bumps 186 may be disposed in the notches 1662. For example, the widths of the bumps 186 are less than the widths of the notches 1662 to achieve floatingly connecting. Hence, the bumps 186 are respectively restricted to the notches 1662 through the guiding structure 1664 when the electrodes 14 are respectively inserted into the electrode notches 184.

In an embodiment, the guiding structure 1664 has a fillet to match a guiding incline 1862 of the bump 186. Hence, the contacting part 166 may deform the elastic part 164 through the interaction between the guiding structure 1664 and guiding incline 1862 of the bump 186. In other words, the elastic part 164 may be moved away from the shell 12 by the interaction between the guiding structure 1664 and the guiding incline 1862 to buckle the bump 186 in the notch 1662.

Figure 6:
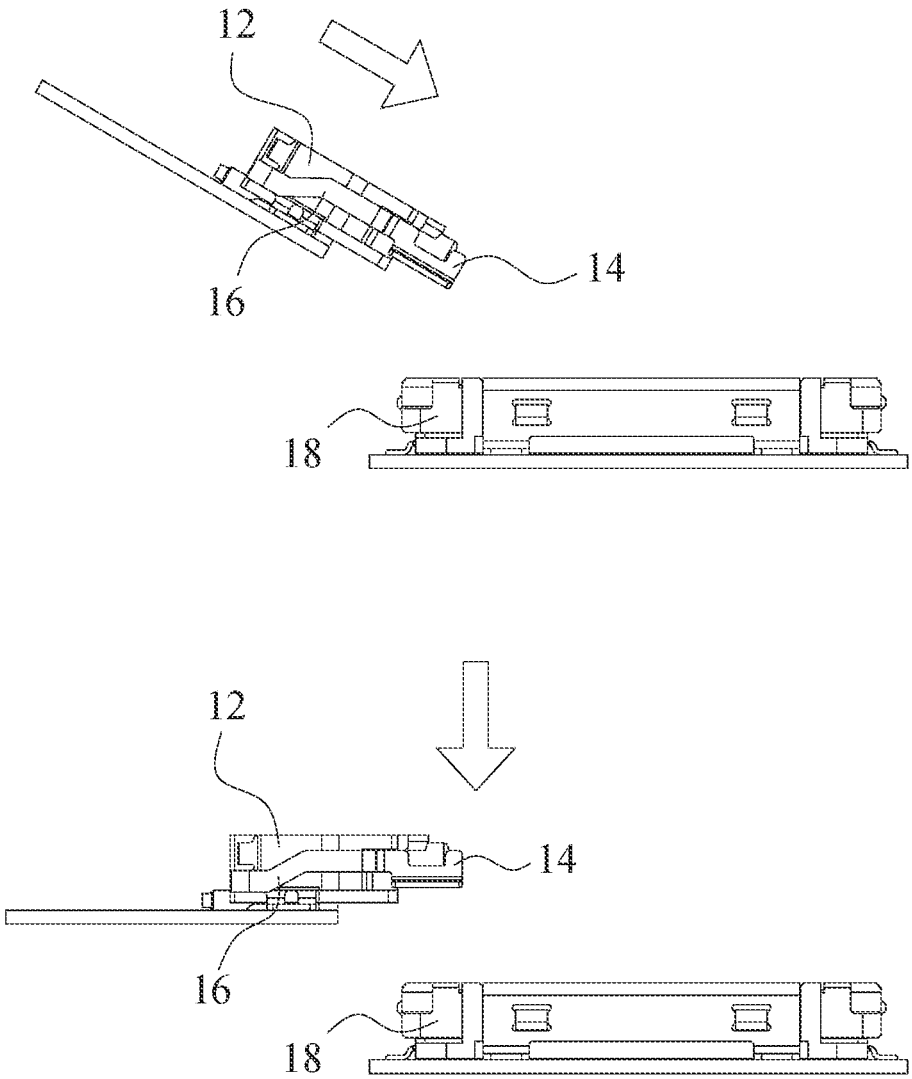
FIG. 6 is a connecting schematic diagram of the floating connector in FIG. 1.

Worthy to notice, in FIG. 5, the floating member 18 has an alignment notch 188 corresponding to an alignment block 124. The alignment block 124 is disposed correspondingly to the alignment notch 188, and the alignment block 124 is inserted into the alignment notch 188, so that the electrodes 14 is corresponding to the electrode notches 184 and the bumps 186 are buckled to the notches 1662. Referring together with FIG. 6, FIG. 6 is a connecting schematic diagram of the floating connector in FIG. 1. In the upper diagram of FIG. 6, the floating member 18 is connected to the shell 12, the electrodes 14 and the buckle members 16 with an angle, particularly through the position alignment of the alignment block 124 and the alignment notch 188. In the lower diagram of FIG. 6, the floating member 18 is connected to the shell 12, the electrodes 14 and the buckle members 16 with an angle of 90 degrees (or called as direct up/direct down), and the alignment block 124 and the alignment notch 188 may also be used in the position alignment of this connecting process. Moreover, the width of the alignment notch 188 is not less than the width of the alignment block 124, and the length of the alignment notch 188 is not less than the length of the alignment block 124. Hence, the alignment block 124 may move in the alignment notch 188 in a direction of left and right, or back and forth (i.e. in a depth direction) to achieve floating connection.

In addition, the alignment notch 188 forms a guiding incline 1882 to restrict the alignment block 124 in the alignment notch 188 by the guiding incline 1882.

Figure 7:
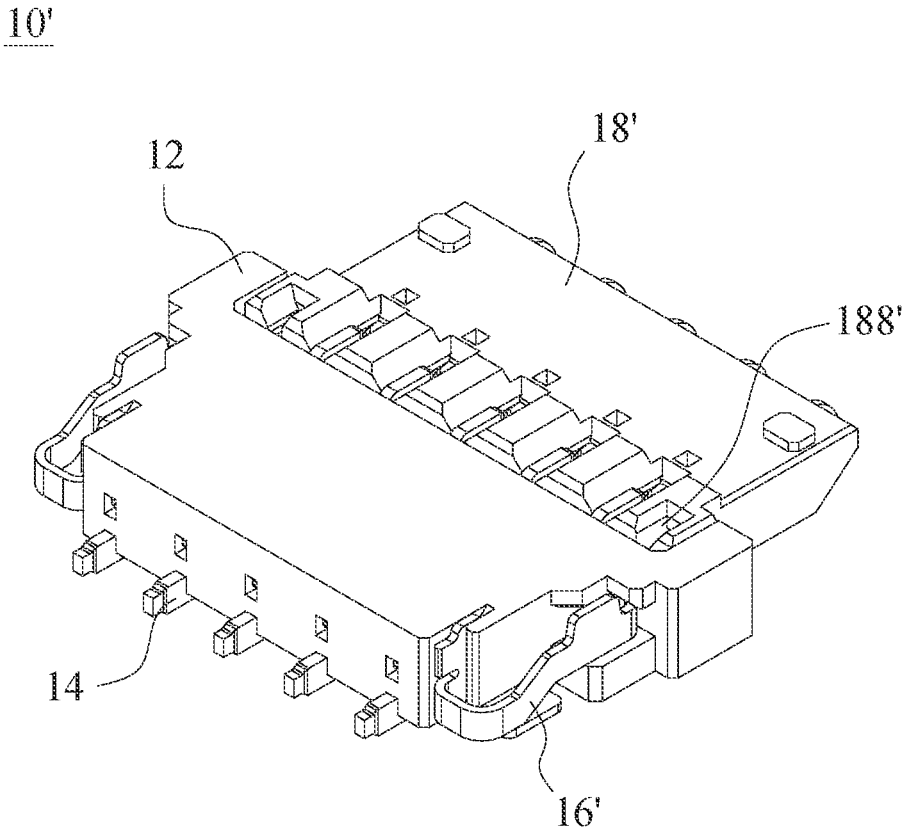
FIG. 7 is a schematic perspective diagram of a floating connector according to another embodiment of the invention.
Figure 8:
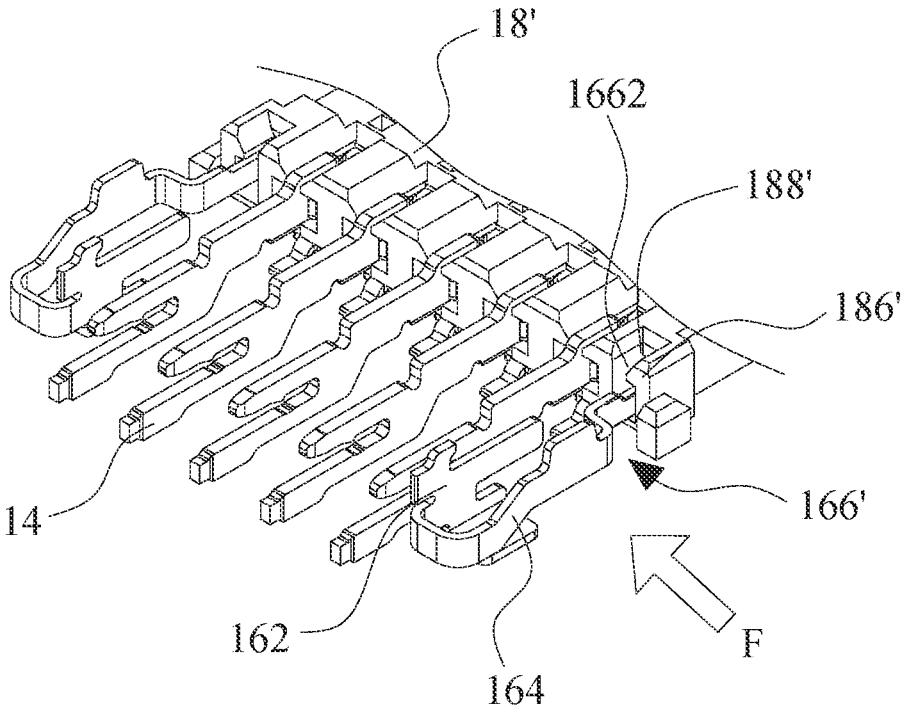
FIG. 8 is a schematic perspective diagram of the electrodes and the buckle members in FIG. 7.

FIG. 7 is a schematic perspective diagram of a floating connector according to another embodiment of the invention; and FIG. 8 is a schematic perspective diagram of the electrodes and the buckle members in FIG. 7. In FIG. 7, a floating connector 10' also comprises a shell 12 and a plurality of electrodes 14 described in the above embodiment while two buckle members 16' and a floating member 18' are different.

The description of the shell 12 and the electrodes 14 are as described above, and the description thereof is thus omitted here.

The difference between the buckle members 16 and the buckle members 16' is the design of a contacting part 166'. The difference between the floating member 18 and the floating member 18' is the design of an alignment notch 188'.

Figure 9:
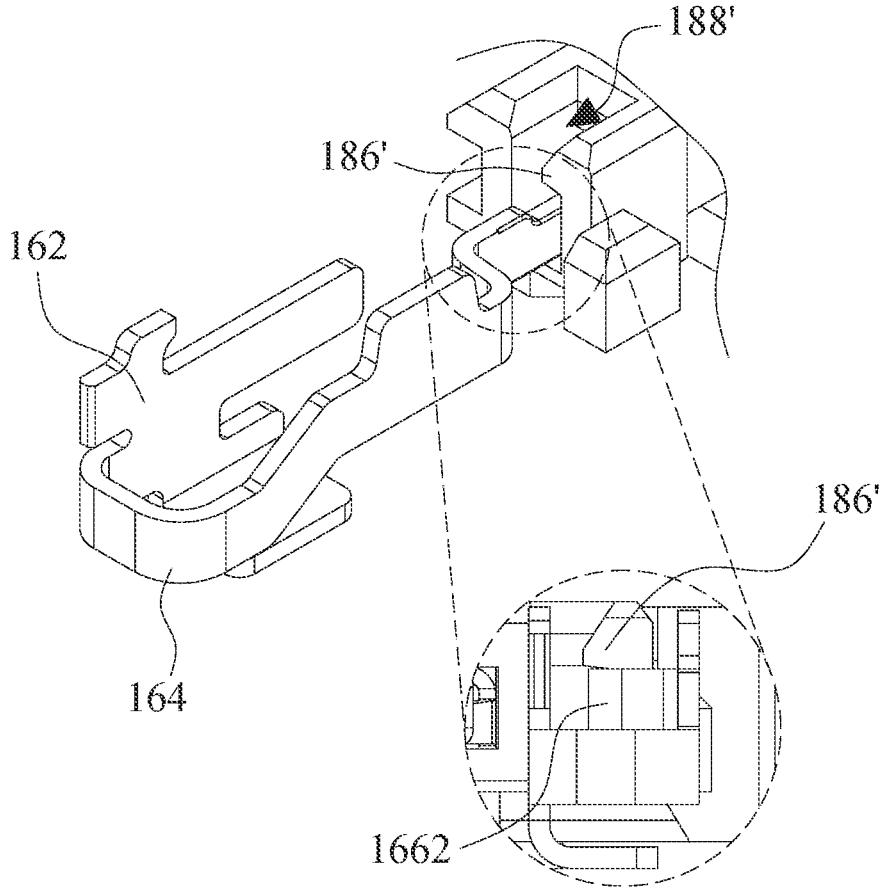
FIG. 9 is a schematic perspective diagram of the notch and the bump in FIG. 8.

Herein, the contacting part 166' is inserted into the alignment notch 188', so that the notch 1662 of the contacting part 166' is stopped by the bump 186' disposed on the alignment notch 188', and the contacting part 166' is fixed to the floating member 18'. In another embodiment, if the elastic part 164 is deformed by an external force F (such as an applied external force F in FIG. 8 in the direction of the arrow), the notch 1662 may be released from the bump 186'. Referring together with FIG. 9, FIG. 9 is a schematic perspective diagram of the notch and the bump in FIG. 8. FIG. 9 provides a viewpoint from the buckle member 16' towards the alignment notch 188' to illustrate the schematic perspective diagram of the notch 1662 and the bump 186'.

Figure 10:
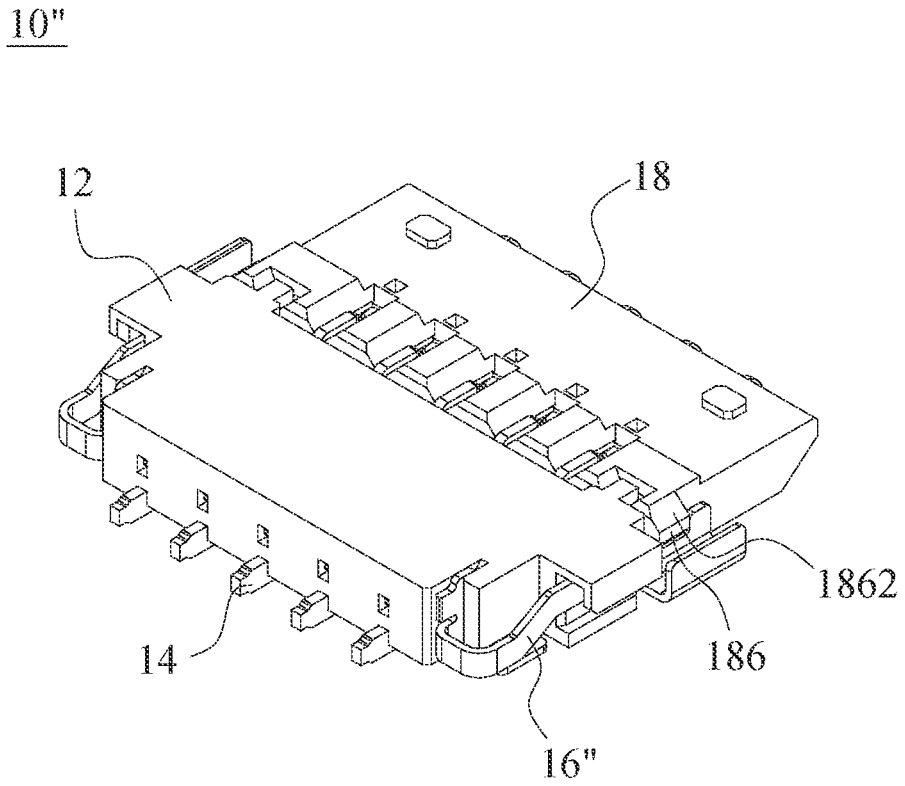
FIG. 10 is a schematic perspective diagram of a floating connector according to still another embodiment of the invention.
Figure 11:
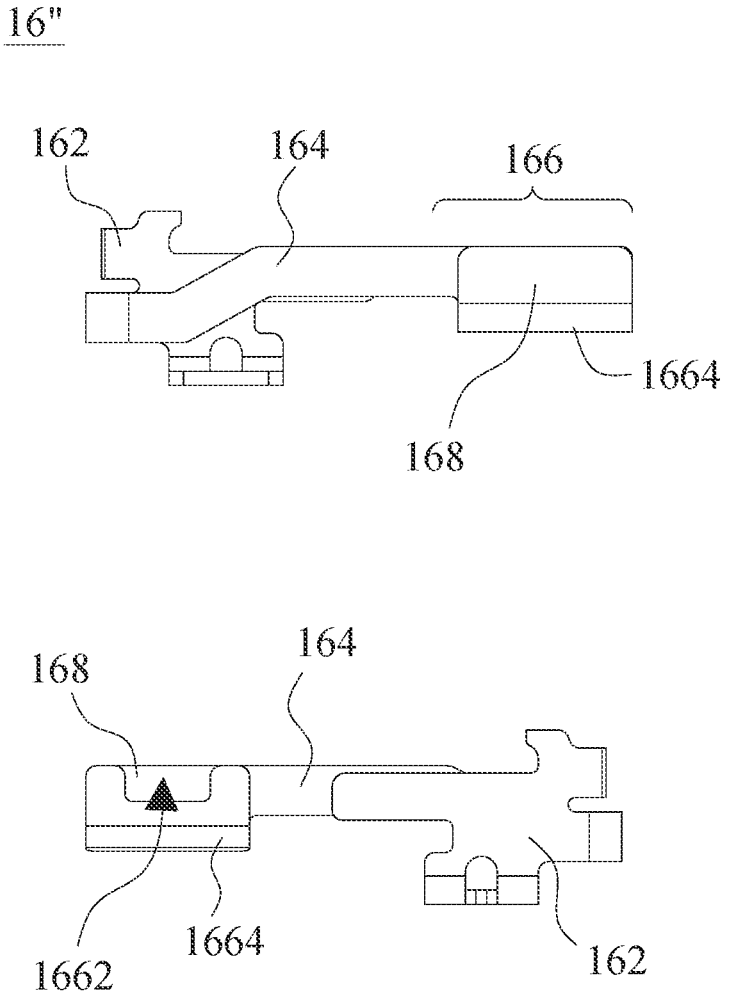
FIG. 11 is a side view diagram of the buckle members in FIG. 10.
Figure 12:
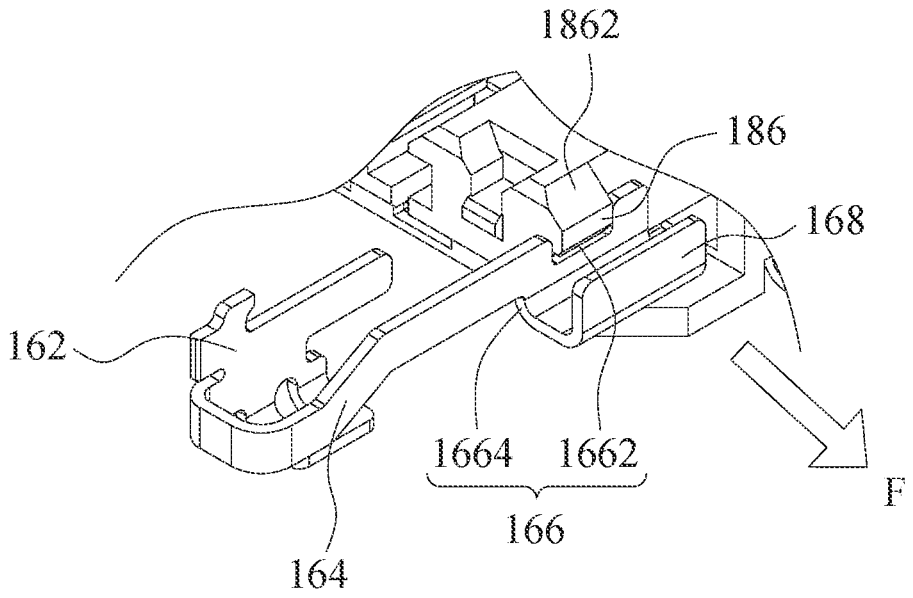
FIG. 12 is a detailed schematic diagram of the buckle members combined with the floating member in FIG. 10.

FIG. 10 is a schematic perspective diagram of a floating connector according to still another embodiment of the invention; FIG. 11 is a side view diagram of the buckle members in FIG. 10; and FIG. 12 is a detailed schematic diagram of the buckle members combined with the floating member in FIG. 10. In FIG. 10, a floating connector 10" also comprises a shell 12, a plurality of electrodes 14, and a floating member 18 described in the above embodiment while two buckle members 16" are different.

The description of the shell 12, the electrodes 14, and the floating member 18 are as described above, and the description thereof is thus omitted here.

In FIG. 11, the buckle members 16" also comprise a fixed part 162, an elastic part 164, and a contacting part 166 described in the above embodiment while two buckle members 16" is different. That is, each of the buckle members 16" further comprises a pick 168.

In this embodiment, the pick 168 extends from the contacting part 166, in particular from the guiding structure 1664. The pick 168 is exposed outside the shell 12, and the elastic portion 164 is deformed by the pick 168 through an external force F (applied in the direction of the arrow) to change the restricted state of the bump 186 by the notch 1662.

This invention has been disclosed above with embodiments, but those skilled in the art should understand that the embodiments are only used to depict this invention and should not be interpreted as limiting the scope of this invention. It should be noted that all changes and replacements equivalent to the embodiments should be included in the scope of this invention. Therefore, the scope of protection of this invention shall be determined by the scope of the claim(s).

What is claimed is:

1. A floating connector comprising:

a shell having an accommodating space and a plurality of openings;

a plurality of electrodes disposed in the accommodating space and penetrating the openings to protrude from the openings;

two buckle members respectively disposed on two sides of the accommodating space, wherein each of the buckle members comprises:

a fixed part disposed in the accommodating space;

a contacting part comprising a notch, and a guiding structure having a pick exposed outside the shell; and an elastic part connecting the fixed part and the contacting part; and a floating member combining the electrodes and the buckle members, wherein the floating member comprises:

a body;

a plurality of electrode notches formed on one side of the body for receiving the electrodes protruding from the openings; and two bumps disposed on two sides of the body and correspondingly to the two notches of the contacting parts of the two buckle members, wherein a width of the bumps is not greater than a width of the notches so that the bumps are restricted in the notches by the guiding structures of the contacting parts of the two buckle members, and the elastic parts are deformed by the picks through an external force to change the restricted state of the bumps by the notches.

2. The floating connector of claim 1, wherein the shell further comprises an alignment block, the floating member further comprises an alignment notch, wherein the alignment block is disposed correspondingly to the alignment notch, and the alignment block is inserted into the alignment notch, so that the electrodes are buckled to the electrode notches 184 correspondingly, and the bumps of the floating members are buckled into the notches of the buckle members.

3. The floating connector of claim 2, wherein the alignment notch forms a guiding incline to restrict the alignment block to the alignment notch by the guiding incline.

4. The floating connector of claim 2, wherein the width of the alignment notch is not less than the width of the alignment block, and the length of the alignment notch is not less than the length of the alignment block.

5. The floating connector of claim 2, wherein the notch and the guiding structure are inserted into the alignment notch, so that the notch is stopped by the bump formed by the alignment notch.

6. The floating connector of claim 5, wherein the elastic part is deformed by an external force to separate the notch from the bump.

7. The floating connector of claim 1, wherein the bump forms a guiding incline, so that the contacting part may deform the elastic part through the interaction between the guiding structure and guiding incline of the bump.

8. The floating connector of claim 1, wherein the guiding structure comprises a fillet.

* * * * *